US008261567B2

(12) United States Patent
Zangari et al.

(10) Patent No.: US 8,261,567 B2
(45) Date of Patent: Sep. 11, 2012

(54) HEAT EXCHANGER COIL WITH WING TUBE PROFILE FOR A REFRIGERATED MERCHANDISER

(75) Inventors: Jony M. Zangari, O'Fallon, MO (US); Wilson S. J. Lawrence, Bangalore (IN)

(73) Assignee: Hussmann Corporation, Bridgeton, MO (US)

( * ) Notice: Subject to any disclaimer, the term of this patent is extended or adjusted under 35 U.S.C. 154(b) by 536 days.

(21) Appl. No.: 12/489,550

(22) Filed: Jun. 23, 2009

(65) Prior Publication Data

US 2010/0319379 A1 Dec. 23, 2010

(51) Int. Cl.
*A47F 3/04* (2006.01)

(52) U.S. Cl. ..... 62/255; 62/515

(58) Field of Classification Search ..... 62/255, 62/252, 246, 515, 513; 165/151, 146, 166
See application file for complete search history.

(56) References Cited

U.S. PATENT DOCUMENTS

| | | | | | |
|---|---|---|---|---|---|
| 1,903,125 | A | * | 3/1933 | Modine | 165/81 |
| 3,103,792 | A | * | 9/1963 | Davids | 62/123 |
| 3,350,891 | A | * | 11/1967 | Pike | 62/535 |
| 3,648,768 | A | * | 3/1972 | Scholl | 165/171 |
| 3,675,436 | A | * | 7/1972 | Ganiaris | 62/535 |
| 3,864,932 | A | * | 2/1975 | Hsiao | 62/123 |
| 3,869,351 | A | * | 3/1975 | Schwartzman | 202/172 |
| 4,096,616 | A | * | 6/1978 | Coffinberry | 29/890.036 |
| 4,135,575 | A | | 1/1979 | Gersch | |
| 4,158,908 | A | * | 6/1979 | Block et al. | 29/890.033 |
| 4,235,281 | A | * | 11/1980 | Fitch et al. | 165/115 |
| 4,245,998 | A | * | 1/1981 | Okouchi et al. | 210/712 |
| 4,285,397 | A | | 8/1981 | Ostbo | |
| 4,300,275 | A | * | 11/1981 | McLaughlin | 29/890.033 |
| 4,389,856 | A | * | 6/1983 | Ibrahim | 62/248 |
| 4,434,112 | A | | 2/1984 | Pollock | |
| 4,745,412 | A | * | 5/1988 | Creaser, Jr. | 343/890 |
| 4,759,402 | A | | 7/1988 | Osojnak | |
| 5,494,099 | A | | 2/1996 | Chiba et al. | |
| 5,513,432 | A | | 5/1996 | Sasaki et al. | |
| 5,647,433 | A | | 7/1997 | Sasaki | |
| 5,678,421 | A | * | 10/1997 | Maynard et al. | 62/407 |
| 6,098,706 | A | * | 8/2000 | Urch | 165/166 |
| 6,389,696 | B1 | * | 5/2002 | Heil et al. | 29/890.039 |
| 6,550,255 | B2 | * | 4/2003 | Rudick et al. | 62/6 |
| 6,742,576 | B2 | | 6/2004 | Bergevin | |
| 6,889,759 | B2 | * | 5/2005 | Derosier | 165/151 |
| 6,907,919 | B2 | * | 6/2005 | Zhang | 165/109.1 |
| 6,912,864 | B2 | * | 7/2005 | Roche et al. | 62/256 |
| 6,918,435 | B2 | | 7/2005 | Dwyer | |
| 6,935,416 | B1 | * | 8/2005 | Tsunoda et al. | 165/166 |
| 6,938,885 | B2 | * | 9/2005 | Koo | 261/112.2 |

(Continued)

FOREIGN PATENT DOCUMENTS

| | | |
|---|---|---|
| BR | MU8501144-4 | 10/2005 |
| EP | 0222176 | 5/1987 |
| FR | 2608747 | 6/1988 |
| JP | 54111157 | 8/1979 |
| JP | 54132845 | 10/1979 |
| JP | 4288469 | 10/1992 |

*Primary Examiner* — Mohammad Ali

(74) *Attorney, Agent, or Firm* — Michael Best & Friedrich LLP

(57) ABSTRACT

A heat exchanger coil for a heat exchanger assembly that has a housing defining at least one airflow path and that is adapted to receive an airflow for heating or cooling refrigerant in the heat exchanger coil. The heat exchanger coil includes a substantially cylindrical tube for receiving the refrigerant, and at least one plate coupled to the tube and oriented so that the direction of the airflow adapted to enter the housing is non-orthogonal relative to the orientation of the plate.

37 Claims, 7 Drawing Sheets

U.S. PATENT DOCUMENTS

| | | | | |
|---|---|---|---|---|
| 6,955,061 | B2 * | 10/2005 | Chiang et al. | 62/255 |
| 7,228,711 | B2 * | 6/2007 | Taras et al. | 62/515 |
| 2001/0042383 | A1 * | 11/2001 | Chiang et al. | 62/246 |
| 2002/0162346 | A1 * | 11/2002 | Chiang et al. | 62/246 |
| 2005/0076662 | A1 * | 4/2005 | Roche et al. | 62/246 |
| 2006/0108109 | A1 | 5/2006 | Romero-Beltran | |
| 2006/0144076 | A1 * | 7/2006 | Daddis et al. | 62/440 |
| 2006/0207277 | A1 * | 9/2006 | Mead et al. | 62/246 |
| 2006/0207280 | A1 * | 9/2006 | Avila et al. | 62/255 |
| 2008/0142201 | A1 * | 6/2008 | Derosier et al. | 165/151 |
| 2008/0250805 | A1 * | 10/2008 | Daddis et al. | 62/246 |

* cited by examiner

HEAT EXCHANGER COIL WITH WING TUBE PROFILE FOR A REFRIGERATED MERCHANDISER

BACKGROUND

The present invention relates to a heat exchanger for a refrigerated merchandiser, and more particularly, the present invention relates to a heat exchanger having a heat exchanger coil for transferring heat between a refrigerant in the heat exchanger coil and air flowing over the heat exchanger coil.

In conventional practice, supermarkets and convenience stores are equipped with refrigerated merchandisers, which may be open or provided with doors, for presenting fresh food or beverages to customers while maintaining the fresh food and beverages in a refrigerated environment or product display area. Typically, cold, moisture-bearing air is provided to the product display area of the merchandiser by passing an airflow over the heat exchange surface of an evaporator. A suitable refrigerant is passed through the evaporator, and as the refrigerant evaporates while passing through the evaporator, heat is absorbed from the air passing through the evaporator. As a result, the temperature of the air passing through the evaporator is lowered for introduction into the product display area. The refrigerant is then directed from the evaporator to a condenser, which transfers heat from the refrigerant to the environment.

Some conventional heat exchangers include round-tube plate-fin coil assemblies, which typically have relatively poor efficiency. Over time, dirt and debris accumulates on these conventional heat exchangers, particularly in stand-alone merchandiser applications located in areas near high customer traffic volume, which can further decrease the heat exchanging efficiency of the associated coil assembly. The fouling caused by dirt, debris, and oils causes an increase in undesirable air-side pressure drop, which lowers the volume of air flowing through the condenser coil. The lower volume of air through the condenser coil reduces the amount of heat rejection from the condenser coil and impedes refrigeration performance by increasing the compressor refrigerant pressure, leading to overall system inefficiency and possible compressor failure. Generally, the greater the tube and fin densities that exist in conventional evaporators and condensers leads to more efficient performance of the associated coil with regard to heat transfer between the refrigerant and surrounding air. However, relatively large tube and fin densities make these heat exchangers more susceptible to fouling by accumulation of foreign matter on the coils.

Other conventional heat exchangers include bare tube coil assemblies to avoid excessive build-up of foreign matter on the coils. However, these bare-tube heat exchangers typically have relatively poor and undesirable heat transfer efficiency due to a relatively small heat transference area. Typically, air flowing over the bare tube forms a thin slow moving fluid layer (i.e., a boundary layer) having decreased pressure in flow direction. Often, substantial wake formation occurs on the trailing side of the bare tube and the airflow moves away from bare tubes that are downstream from the leading bare tube, which undesirably affects heat exchanger performance.

Generally, the performance of heat exchangers deteriorates as foreign matter builds up on the heat exchanger coil and the free flow of air through the heat exchanger becomes restricted, and in extreme cases halted. The build up of foreign matter on the heat exchanger coils reduces the amount of air that can pass between the coils, which restricts the heat exchange capability of the heat exchanger. Flow of adequately refrigerated air to the product display area decreases as a consequence of foreign matter buildup, which necessitates relatively frequent cleaning of the heat exchanger coils that may be detrimental to the food and/or beverage products, since the products may be allowed to warm-up to a temperature above desired temperature ranges. Cleaning conventional heat exchangers also typically results in increased energy expenditures and increased costs due to the relatively high frequency of the cleaning operation and a relatively large amount of energy that is required to initially "pull down" the air temperature in the product display area to an acceptable temperature after a cleaning operation.

SUMMARY

In one construction, the invention provides a heat exchanger coil for a heat exchanger assembly that has a housing defining at least one airflow path and that is adapted to receive an airflow for heating or cooling refrigerant in the heat exchanger coil. The heat exchanger coil includes a substantially cylindrical tube for receiving the refrigerant, and at least one plate coupled to the tube and oriented so that the direction of the airflow adapted to enter the housing is non-orthogonal relative to the orientation of the plate In another construction, the invention provides a heat exchanger assembly that includes a housing adapted to receive an airflow and defining at least one airflow path therethrough, an inlet manifold having an inlet port for receiving refrigerant, an outlet manifold including an outlet port for discharging the refrigerant, and a heat exchanger coil coupled to and extending between the inlet manifold and the outlet manifold. The heat exchanger coil includes a plurality of coil sections that are spaced apart from each other. Each of the coil sections has a substantially cylindrical tube and at least one plate coupled to the tube and oriented so that the direction of the airflow adapted to enter the housing is non-orthogonal relative to the orientation of the plate.

In yet another construction, the invention provides a self-contained refrigerated merchandiser that includes a case, a fan assembly, and a heat exchanger assembly. The case defines a product display area and includes a rear wall partially defining a rear passageway and an accessible refrigeration compartment. The fan assembly includes a fan that is positioned in at least one of the rear passageway and the refrigeration compartment for generating an airflow. The heat exchanger assembly defines at least one airflow path and includes a housing that is positioned to receive the airflow generated by the fan, an inlet manifold for receiving refrigerant, an outlet manifold for discharging the refrigerant, and a heat exchanger coil coupled to and extending between the inlet manifold and the outlet manifold. The heat exchanger coil includes a plurality of coil sections that are spaced apart from each other. Each of the coil sections has a substantially cylindrical tube and at least one plate that is coupled to the tube and oriented so that the direction of the airflow adapted to enter the housing is non-orthogonal relative to the orientation of the plate.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or otherwise limited, "connected" and "coupled" are not restricted to physical or mechanical connections or couplings.

Figure 1:
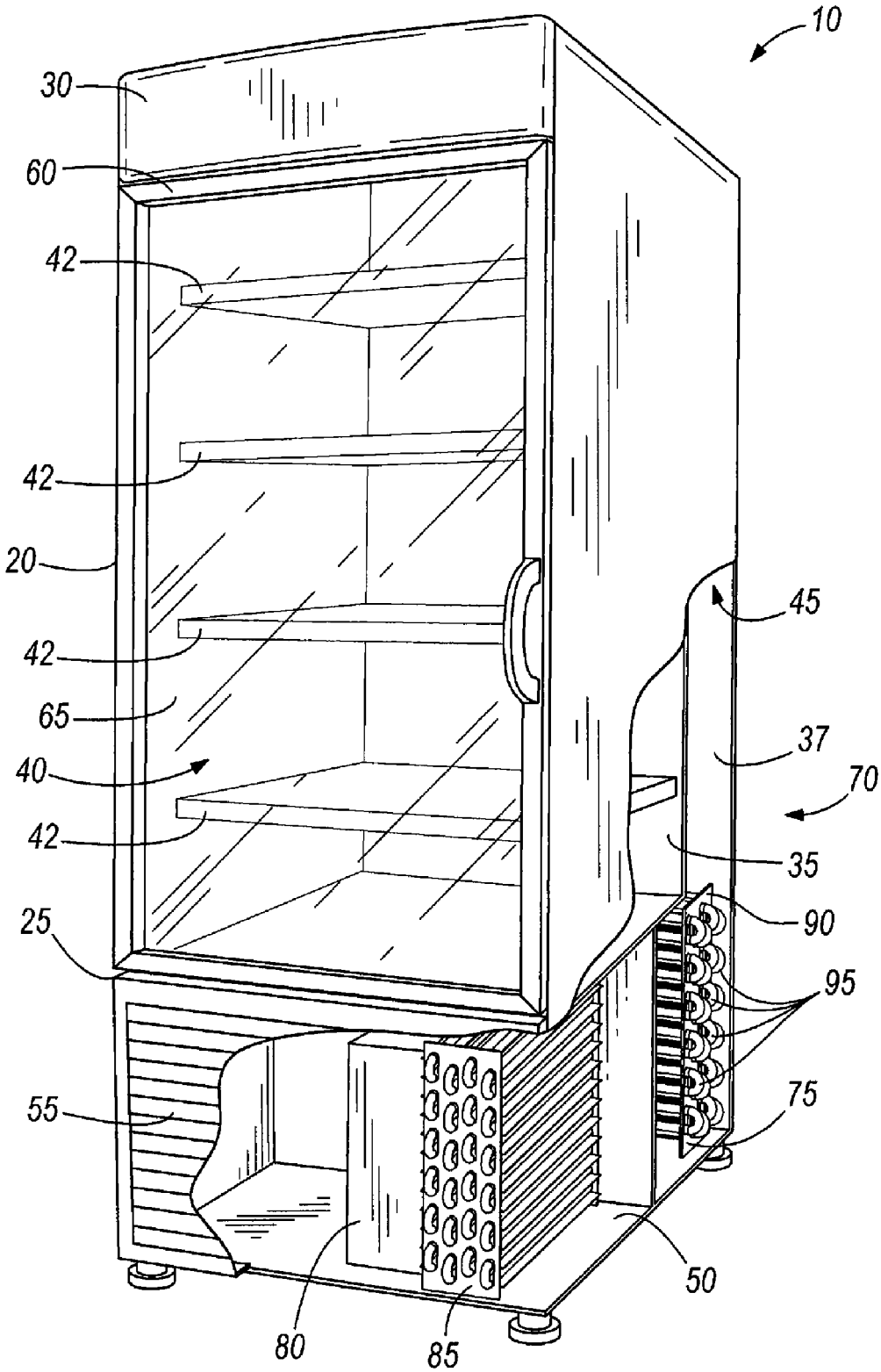
FIG. 1 is a perspective view of a stand-alone refrigerated merchandiser including an evaporator assembly and a condenser assembly embodying the invention.

FIG. 1 shows a refrigerated merchandiser 10 that may be located in a supermarket or a convenience store (not shown) or other locations for presenting product to consumers. In the illustrated construction, the merchandiser 10 is a self-contained merchandiser, although other merchandisers are also considered herein. In some constructions, the merchandiser 10 may be a medium temperature merchandiser. In other constructions, the merchandiser 10 may be a low temperature merchandiser (e.g., a freezer).

The refrigerated merchandiser 10 includes a case 20 that has a base 25, a case top 30, a rear wall 35, and an external wall 37. The area partially enclosed by the base 25, the case top 30, and the rear wall 35 defines a product display area 40 for supporting and displaying product on one or more shelves 42. The rear wall 35 and the external wall 37 cooperate to define a rear passageway 45 that is in communication with the product display area 40.

The base 25 defines a refrigeration compartment 50 that is accessible through an opening adjacent the front of the merchandiser 10. Generally, the refrigeration compartment 50 is separated into a rear portion and a front portion by an insulated wall. A louvered cover 55 is positioned over the opening to enclose and obscure the refrigeration compartment 50 from view, and to allow air to enter the refrigeration compartment 50 from the environment outside the merchandiser 10.

The merchandiser 10 also includes a door 60 that is pivotally attached to the case 20 to allow access to the product in the product display area 40. The door 60 includes a glass member 65 that allows viewing of the product by consumers and others from outside the case 20. In some constructions, the case 20 may include more than one door 60 to allow access to the product display area 40. In other constructions, the refrigerated merchandiser 10 may be an open-front merchandiser.

FIG. 1 shows a portion of a refrigeration system 70 of the merchandiser 10 that maintains the product in the product display area 40 at a desired temperature. The illustrated refrigeration system 70 includes an evaporator assembly 75, a fan assembly 80, and a condenser assembly 85. The refrigeration system 70 may also include other components, such as one or more compressors, a receiver, and one or more expansion valves (not shown) that are supported by the case 20 or located remotely from the merchandiser 10. Other refrigeration system 70 components (not shown) may also be supported by the case 20. In other constructions, the merchandiser 10 may be positioned adjacent or coupled to other merchandisers (not shown). In these constructions, some of the refrigeration system 70 components (e.g., the condenser assembly 85, the compressor, etc.), may be located remote from the merchandiser 10 and/or shared with other merchandisers for common use.

As illustrated in FIG. 1, the evaporator assembly 75 is positioned in the rear portion of the refrigeration compartment 50 in communication with the rear passageway 45 to refrigerate the air directed toward the product display area 40. In other constructions, the evaporator assembly may be located elsewhere in the merchandiser 10. The evaporator assembly 75 includes an evaporator housing 90 and evaporator coils 95 coupled to the evaporator housing 90. In some constructions, the refrigerated merchandiser 10 may include one or more fans (not shown) that are located in the rear passageway 45 downstream and/or upstream of the evaporator assembly 75 to partially generate a refrigerated airflow through the rear passageway 45.

The fan assembly 80 is positioned in the refrigeration compartment 50 adjacent the condenser assembly 85 to draw air into the refrigeration compartment 50 through the cover 55 for circulation through the condenser assembly 85. The fan assembly 80 is positioned in the front portion of the refrigeration compartment 50 opposite the evaporator assembly 75. The fan assembly 80 can include one or more fans to draw the air through the condenser assembly 85.

Figure 2:
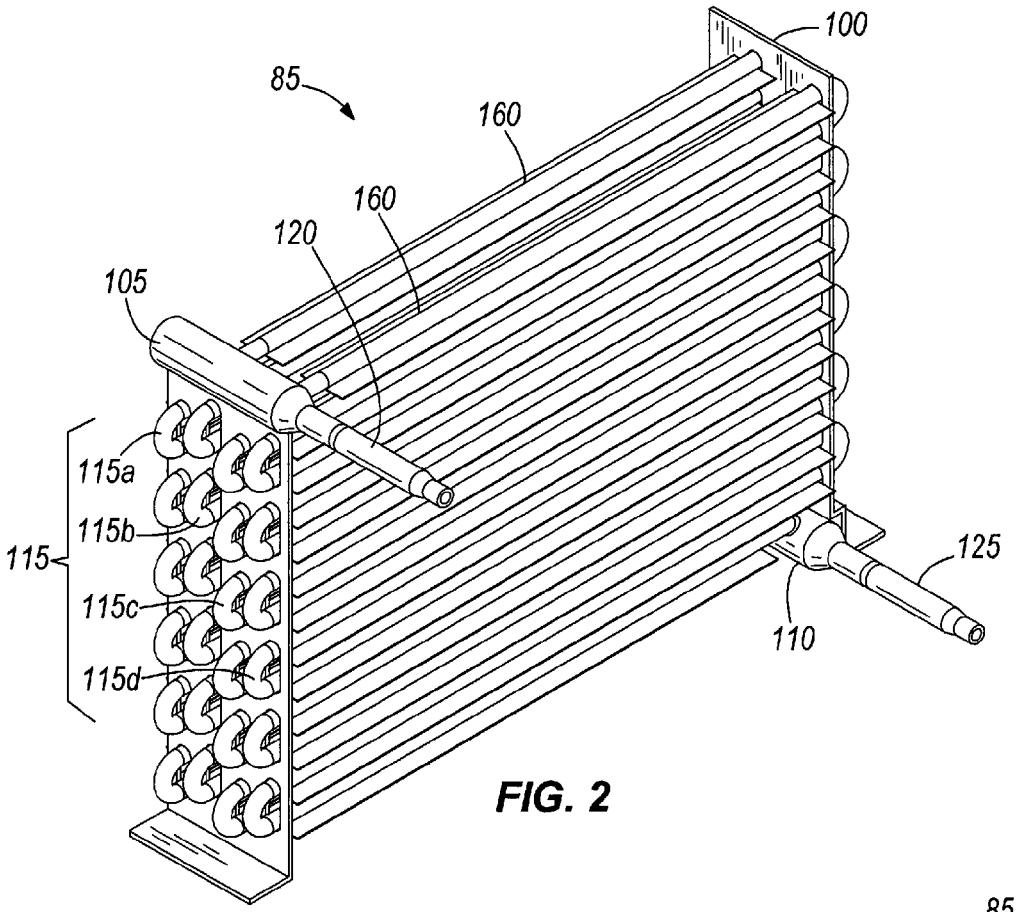
FIG. 2 is a perspective view of the condenser assembly of FIG. 1 including an inlet manifold, an outlet manifold, and a condenser coil.
Figure 3:
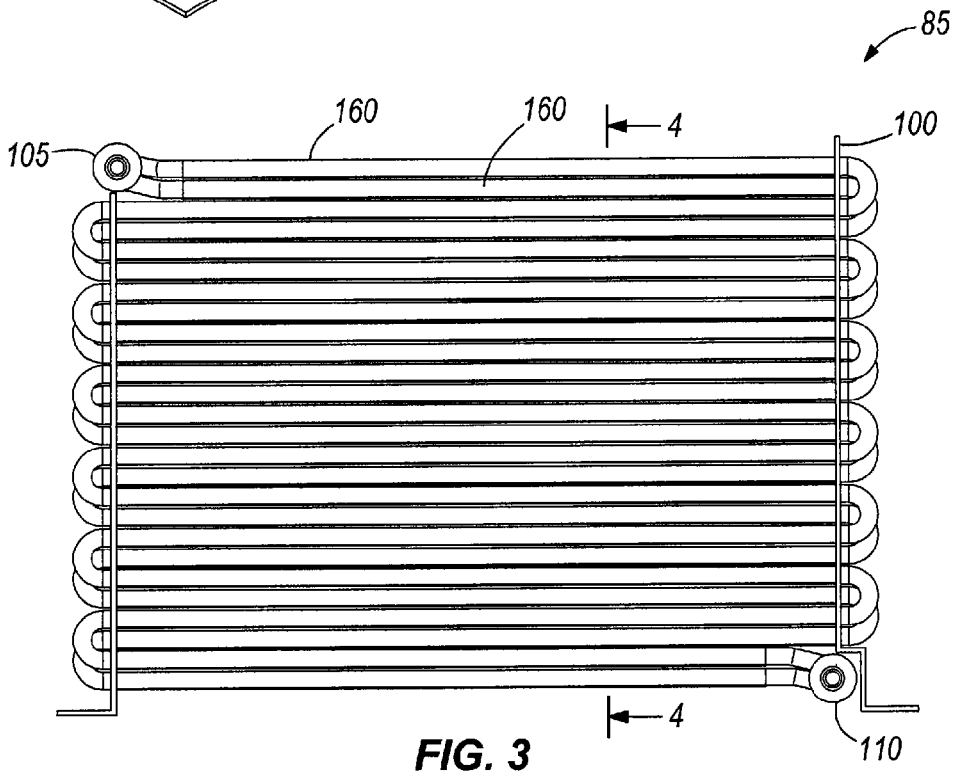
FIG. 3 is a front view of the condenser assembly of FIG. 2 including condenser coils having a plurality of coil sections.
Figure 4:
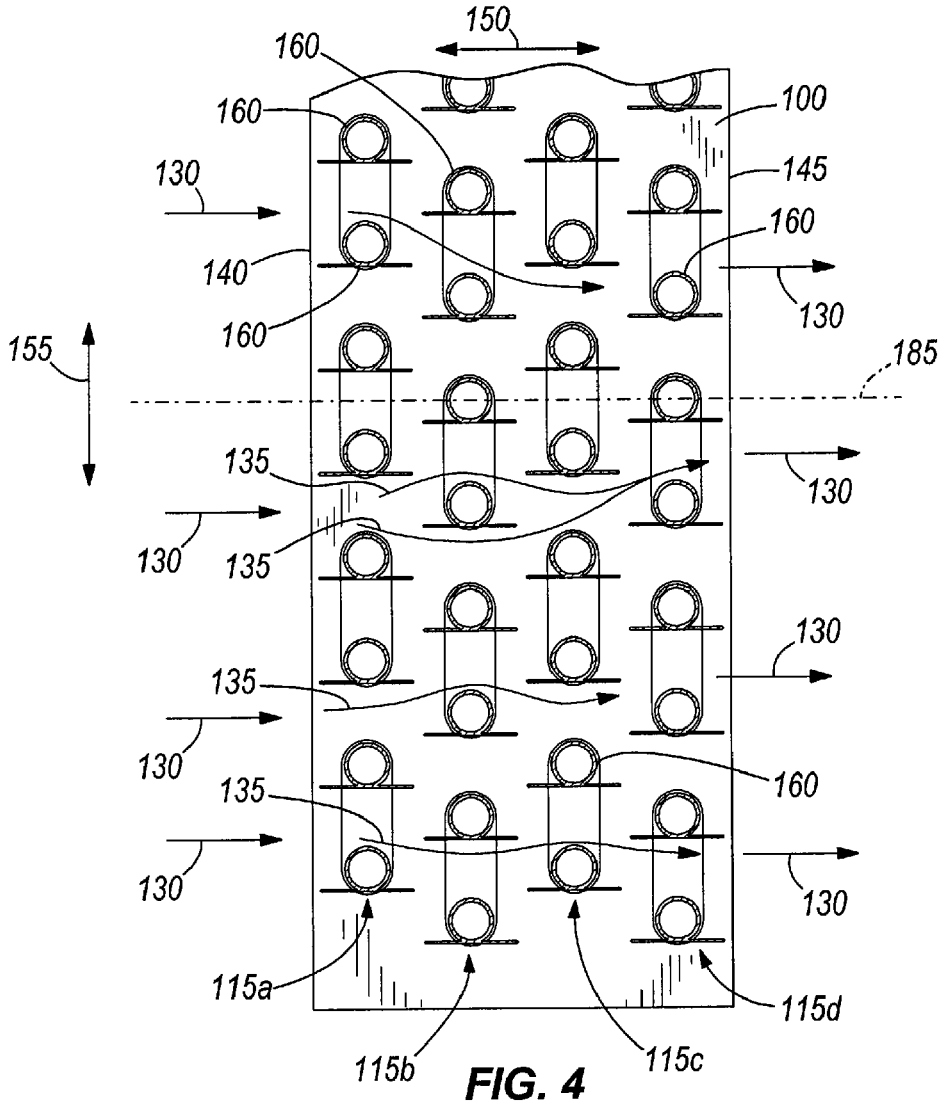
FIG. 4 is a section view of the condenser assembly of FIG. 3 taken along line 4-4 and including the plurality of coil sections.

FIG. 1 shows the condenser assembly 85 positioned in the front portion of the refrigeration compartment 50 adjacent the cover 55 and the fan assembly 80. In other constructions, the condenser assembly 85 may be located elsewhere in the merchandiser 10, or remote from the merchandiser 10. As illustrated in FIGS. 2-4, the condenser assembly 85 includes a condenser housing 100, an inlet manifold 105, an outlet manifold 110, and condenser coils 115. The inlet manifold 105 has an inlet port 120 for receiving refrigerant from the compressors. The outlet manifold 110 has an outlet port 125 for discharging the refrigerant to the evaporator assembly 75. In some constructions, the condenser assembly 85 may be without inlet and outlet manifolds (e.g., a continuous tube condenser assembly).

In the illustrated construction, the condenser assembly 85 is generally upright within the refrigeration compartment 50 and is adapted to receive an airflow 130 generated by the fan assembly 80 in a substantially horizontal direction (see FIG. 4). In other constructions, the condenser assembly 85 may have a different orientation relative to the incoming airflow 130 such that the airflow 130 enters the condenser assembly 85 at in an angular direction, or in a substantially vertical direction.

FIG. 4 shows that the airflow 130 enters the condenser housing 100 adjacent a leading side 140 of the condenser assembly 85, and exits the condenser housing 100 adjacent a trailing side 145 of the condenser assembly 85. The condenser housing 100 defines airflow paths 135 between the leading side 140 and the trailing side 145. The condenser housing 100 also defines a lateral direction 150 (e.g., a horizontal direction in FIG. 4 corresponding to a width of the condenser assembly 85 between the leading side 140 and the trailing side 145 along the airflow paths 135), and a longitudinal direction 155 (e.g., a vertical direction in FIG. 4 corresponding to a height of the condenser assembly 85) between an upper portion of the condenser assembly 85 and a lower portion of the condenser assembly 85. In the illustrated construction, the longitudinal direction 155 is substantially transverse to the airflow 130 entering the condenser housing 100 and the lateral direction 150.

The condenser assembly 85 illustrated in FIGS. 2-4 includes four condenser coils 115*a*, 115*b*, 115*c*, 115*d* that are disposed in the condenser housing 100 and that meander generally downward between the sides of the condenser housing 100. Each of the condenser coils 115*a*, 115*b*, 115*c*, 115*d* is coupled to and extends between the inlet manifold 105 and the outlet manifold 110 so that refrigerant generally flows from the inlet manifold 105 to the outlet manifold 110 (e.g., by gravity).

As shown in FIG. 4, each condenser coil 115*a*, 115*b*, 115*c*, 115*d* is spaced apart from the remaining condenser coils 115*a*, 115*b*, 115*c*, 115*d* in the lateral direction 150, and includes a plurality of coil sections 160 that are spaced apart from each other in the longitudinal direction 155. Thus, the coil sections 160 of the second condenser coil 115*b* are staggered relative to the coil sections 160 of the first condenser coil 115*a* and the coil sections 160 of the third condenser coil 115*c*. Similarly, the coil sections 160 of the fourth condenser coil 115*d* are staggered relative to the coil sections 160 of the first condenser coil 115*a* and the third condenser coil 115*c*. The staggered relationship between the condenser coils 115 defines a generally resistive and turbulent flow path for the airflow 130 to provide ample heat transfer between the refrigerant in the condenser coils 115 and the airflow 130 through the condenser housing 100. In other constructions, the coil sections 160 of each of the condenser coils 115 can be aligned with the coil sections 160 of one or more of the remaining condenser coils 115.

Figure 5:
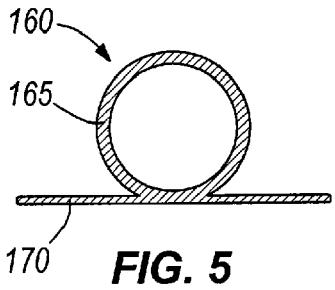
FIG. 5 is a section view of one of the plurality of coil sections of FIG. 4.

FIG. 5 shows one of the coil sections 160 for the condenser assembly 85. Each coil section 160 includes a substantially cylindrical tube 165 and a plate 170 that is coupled to the tube 165. In the illustrated construction, the tube 165 has a diameter of approximately 0.625 inches, and the plate 170 has a width of approximately one inch (see FIG. 5). In other constructions, the diameter of the tube 165 can be another diameter based on desired heat transfer characteristics and desired refrigerant flow through the condenser coils 115. Similarly, the width of the plate 170 can vary depending on the desired heat transfer characteristics of the condenser assembly 85 and the diameter of the associated tube 165.

The tube 165 and the plate 170 cooperate to define a wing tube profile that increases the surface area of the coil sections 160 relative to conventional condenser coils 115. The tube 165 receives the refrigerant from the inlet manifold 105 and directs the refrigerant toward the outlet manifold 110. The tube 165 can be formed from any suitable material, including metals (e.g., aluminum, steel, composite metals,), plastics, composites, etc. The tube 165 also can be formed using any suitable manufacturing method (e.g., extrusion, welding, etc.). In some constructions, the tube 165 can be formed as a continuous tube without manifolds. In other constructions, the tube may be formed by other means.

FIG. 4 shows that the plate 170 of each coil section 160 is substantially parallel to an axis 185 extending through the condenser housing 100 (e.g., along the lateral direction 150) such that the plates 170 of the coil sections 160 are substantially parallel to each other. The airflow 130 is directed toward the condenser assembly 85 such that the airflow 130 prior to entry into the condenser assembly 85 is generally non-orthogonal relative to the orientation of the plates 170. As illustrated in FIG. 4, the direction of the airflow 130 entering the housing 100 is substantially along the axis 185 parallel to the plates 170 (e.g., the airflow 130 is substantially horizontal in FIG. 4). In other words, the airflow 130 is directed toward the condenser assembly 85 such that the airflow paths 135 flow generally across or over the coil sections 160 substantially along the lateral direction. Similarly, the airflow exiting the condenser assembly 85 is directed away from the condenser coils 115 in a direction that is substantially parallel to the plates 170.

As illustrated in FIG. 5, one plate 170 is tangentially coupled to the tube 165 adjacent a bottom of the tube 165 to define an Omega-wing tube profile. In other constructions, two plates may be used to define the Omega-wing tube profile. The plate 170 is substantially planar and can be attached to the tube 165 using any suitable manufacturing method (e.g., brazing, welding, etc.). The plate 170 can be formed from any suitable material that is the same or different from the material used for the tube 165 (e.g., aluminum, steel, composite metals, plastics, composites, etc.).

Figure 6:
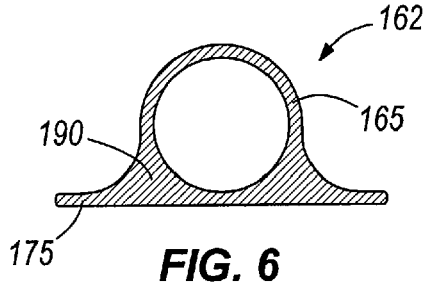
FIG. 6 is a section view of another exemplary coil section for the condenser coils of FIG. 2.

FIG. 6 shows another construction of a coil section 162 that can be incorporated into the condenser coils 115. The coil section 162 includes the tube 165 and a plate 175 that is coupled to the tube 165 to define another Omega-wing tube profile that is similar to the Omega-wing tube profile described with regard to FIG. 5, except that the attachment area between the tube 165 and the plate 175 is larger than the attachment area of the Omega-wing tube profile of FIG. 5. In particular, the plate 175 shown in FIG. 6 is tangentially coupled to the tube 165 adjacent a bottom of the tube 165, and filleted transitions 190 extend between the tube 165 and the plate 175 to define a relatively smooth contour of the coil section 162.

Figure 7:
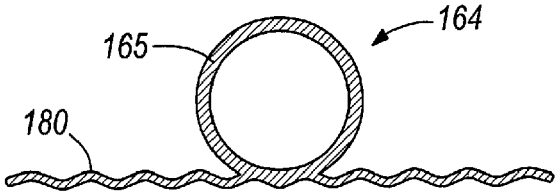
FIG. 7 is a section view of another exemplary coil section for the condenser coils of FIG. 2.

FIG. 7 shows another construction of a coil section 164 that can be incorporated into the condenser coils 115. The coil section 164 illustrated in FIG. 7 includes the tube 165 and a plate 180 that has a non-planar or wavy profile coupled to the tube 165 to define another Omega-wing tube profile that is similar to the Omega-wing tube profile described with regard to FIG. 5. The non-planar plate 180 has a relatively large surface area, which increases the heat transfer capability of the coil section 160.

Referring back to FIG. 4, the coil sections 160 are oriented in the condenser housing 100 so that the plates 170 are substantially parallel to each other and extend in the lateral direction 150 (e.g., the plates 170 are substantially horizontal as viewed in FIG. 4). The horizontally-oriented, staggered coil sections 160 cooperate with each other to define a staggered airflow path 135 through the condenser housing 100 such that the airflow 130 between two coil sections 160 of the first condenser coil 115*a* flows above and below an adjacent coil section 160 of the second condenser coil 115*b*. In other constructions, the plates 170 may be oriented at a non-zero angle (e.g., 30 degrees, 45 degrees, 60 degrees) relative to the lateral direction 150.

Figure 8:
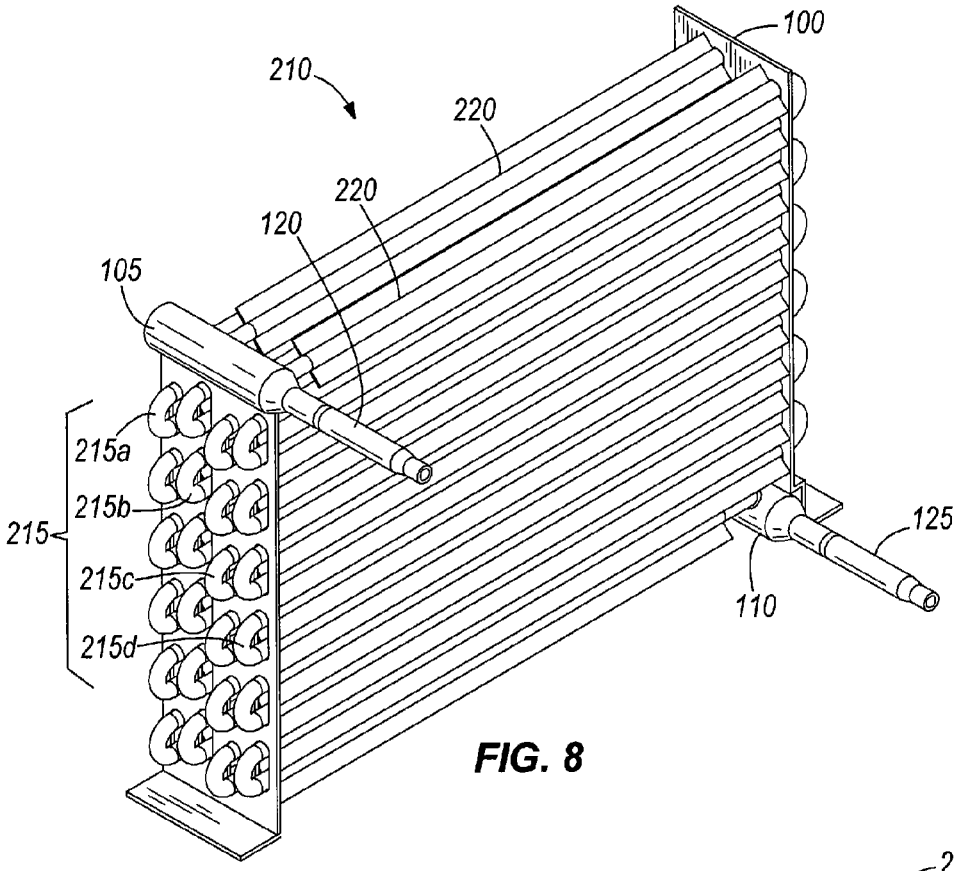
FIG. 8 is a perspective view of another condenser assembly for use in the refrigerated merchandiser of FIG. 1, including an inlet manifold, an outlet manifold, and a condenser coil.
Figure 9:
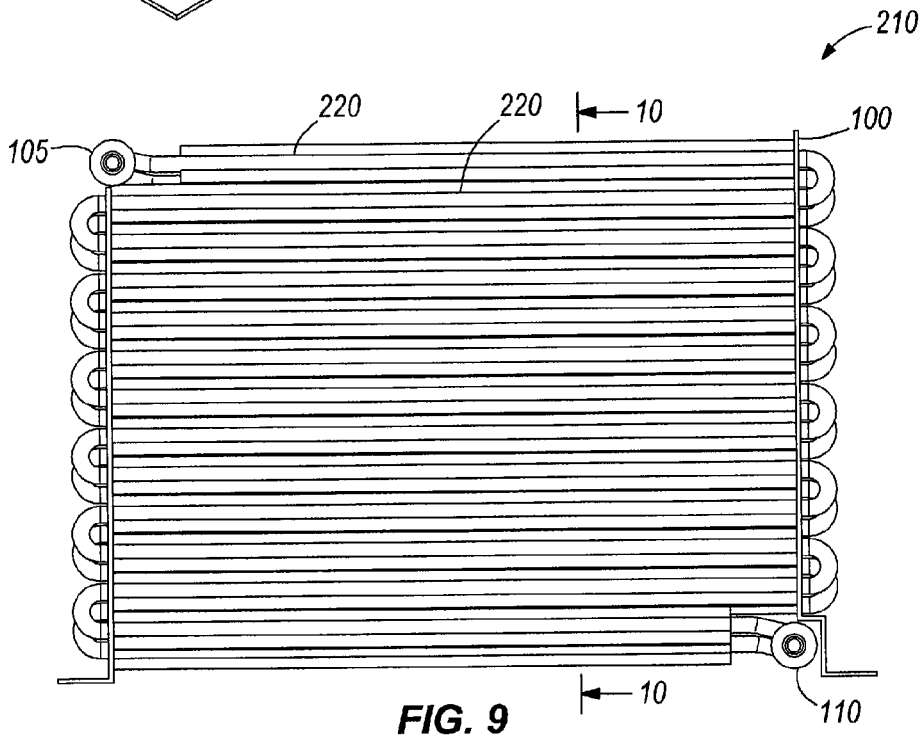
FIG. 9 is a front view of the condenser assembly of FIG. 8 including a plurality of coil sections.
Figure 10:
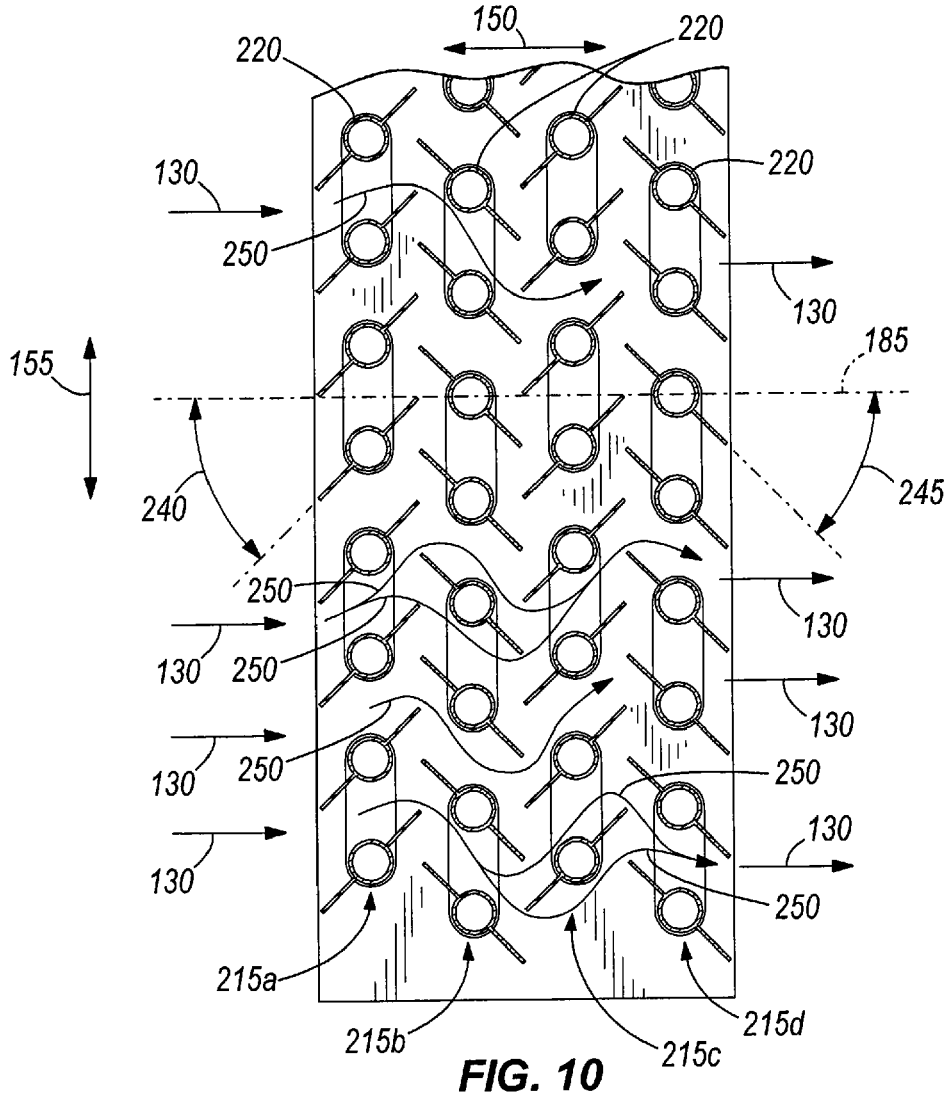
FIG. 10 is a section view of the condenser assembly of FIG. 9 taken along line 10-10.

FIGS. 8-11 show another condenser assembly 210 that is positionable in the refrigeration compartment 50 of the refrigerated merchandiser 10. Except as described below, the condenser assembly 210 is the same as the condenser assembly 85 described with regard to FIGS. 1-4, and common elements have the same reference numerals. As illustrated in FIGS. 8-10, the condenser assembly 210 includes the condenser housing 100 defining the lateral direction 150 and the longitudinal direction 155, the inlet manifold 105, the outlet manifold 110, and condenser coils 215.

The condenser assembly 210 illustrated in FIGS. 8-10 includes four condenser coils 215*a*, 215*b*, 215*c*, 215*d* that are disposed in the condenser housing 100 and that meander generally downward between the sides of the condenser housing 100 from the inlet manifold 105 to the outlet manifold 110. FIG. 10 shows that the airflow 130 enters the condenser housing 100 adjacent the leading side 140 of the condenser assembly 210, and exits the condenser housing 100 adjacent the trailing side 145 of the condenser assembly 210.

As shown in FIG. 10, each condenser coil 215 is spaced apart from the remaining condenser coils 215 in the lateral direction 150, and includes a plurality of coil sections 220 that are spaced apart from each other in the longitudinal direction 155. In other words, the coil sections 220 of the second condenser coil 215*b* are staggered relative to the coil sections 220 of the first condenser coil 215*a* and the coil sections 220 of the third condenser coil 215*c*, and the coil sections 220 of the fourth condenser coil 215*d* are staggered relative to the coil sections 220 of the first condenser coil 215*a* and the third condenser coil 215*c*. The staggered relationship between the condenser coils 215 defines a generally resistive and turbulent flow path to provide ample heat transfer between the refrigerant in the condenser coils 215 and the airflow 130 through the condenser housing 100.

Figure 11:
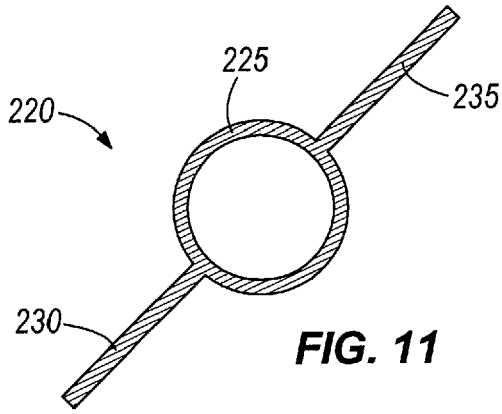
FIG. 11 is a section view of one of the plurality of coil sections of FIG. 10.

FIG. 11 shows one of the coil sections 220 for the condenser assembly 210. The coil section 220 includes a substantially cylindrical tube 225, a first plate 230 coupled to the tube 225, and a second plate 235 coupled to the tube 225 diametrically opposite the first plate 230. The tube 225 and the first and second plates 230, 235 cooperate to define a wing tube profile that increases the surface area of the coil sections 220 as compared to conventional condenser coils 215. As illustrated in FIG. 10, the plates 230, 235 of each of the coil sections 220 of the first and third condenser coils 215*a*, 215*c* are oriented at a first non-zero angle 240 relative to the axis 185 through the condenser housing 100. As shown in FIG. 10, the axis 185 corresponds to the direction of airflow 130 entering the condenser housing 100 (e.g., the lateral direction 150). The plates 230, 235 of each of the coil sections 220 of the second and fourth condenser coils 215*b*, 215*d* are oriented at a second non-zero angle 245 relative to the axis 185. In the illustrated construction, the plates 230, 235 of the coil sections 220 of the second and fourth condenser coils 215*b*, 215*d* extend in a substantially opposite direction relative to the plates 230, 235 of the first and third condenser coils 215*a*, 215*c*. In other constructions, the plates 230, 235 of the respective condenser coils 215 may be substantially parallel to each other. In still other constructions, the plates 230, 235 of the respective condenser coils 215 may be non-parallel to each other and extend in non-opposite directions.

In the illustrated construction, the first non-zero angle 240 and the second non-zero angle 245 are both approximately 45 degrees such that the plates 230, 235 of the second condenser coil 215*b* are substantially orthogonal to the plates 230, 235 of the first condenser coil 215*a* and the third condenser coil 215*c*. Similarly, the plates 230, 235 of the fourth condenser coil 215*d* are substantially orthogonal to the plates 230, 235 of the first and third condenser coils 215*a*, 215*c* (e.g., parallel to the plates 230, 235 of the second condenser coil 215*b*). In other constructions, the first non-zero angle 240 and the second non-zero angle 245 may be larger or smaller than 45 degrees. In still other constructions, the first non-zero angle 240 may be different from the second non-zero angle 245.

As shown in FIG. 10, the plates 230, 235 of the respective condenser coils 215 are parallel with each other, and define airflow paths 250 between the leading and trailing sides 140, 145 of the condenser assembly 210 and around the coil sections 220. The airflow 130 is directed toward the condenser assembly 210 such that the airflow 130 prior to entry into the condenser assembly 210 is generally non-orthogonal relative to the orientation of the plates 230, 235. FIG. 10 shows that the direction of the airflow 130 is angled relative to the orientation of the plates 230, 235 (e.g., the airflow 130 is directed in a non-orthogonal, non-parallel direction relative to the orientation of the plates 230, 235). In the illustrated construction, the airflow 130 is substantially horizontal and the plates 230, 235 are disposed at non-horizontal angles (e.g., the first non-zero angle 240 or the second non-zero angle 245). In other words, the airflow 130 is directed toward the condenser assembly 210 such that the airflow paths 250 flow generally across or over the coil sections 220 substantially along the lateral direction 150. Similarly, the airflow exiting the condenser assembly 210 is directed away from the condenser coils 215 in a direction that is angled relative to the orientation of the plates 230, 235. In particular, the airflow 130 is directed away from the condenser coils 215 in a non-orthogonal, non-parallel direction relative to the orientation of the plates 230, 235.

The staggered relationship between adjacent condenser coils 215 and the orientation of the plates 230, 235 of each coil section 220 divide or direct the incoming airflow 130 into multiple airflow paths 250 through the condenser housing 100, which improves heat transfer between the refrigerant and the airflow 130 through the condenser housing 100.

Figure 12:
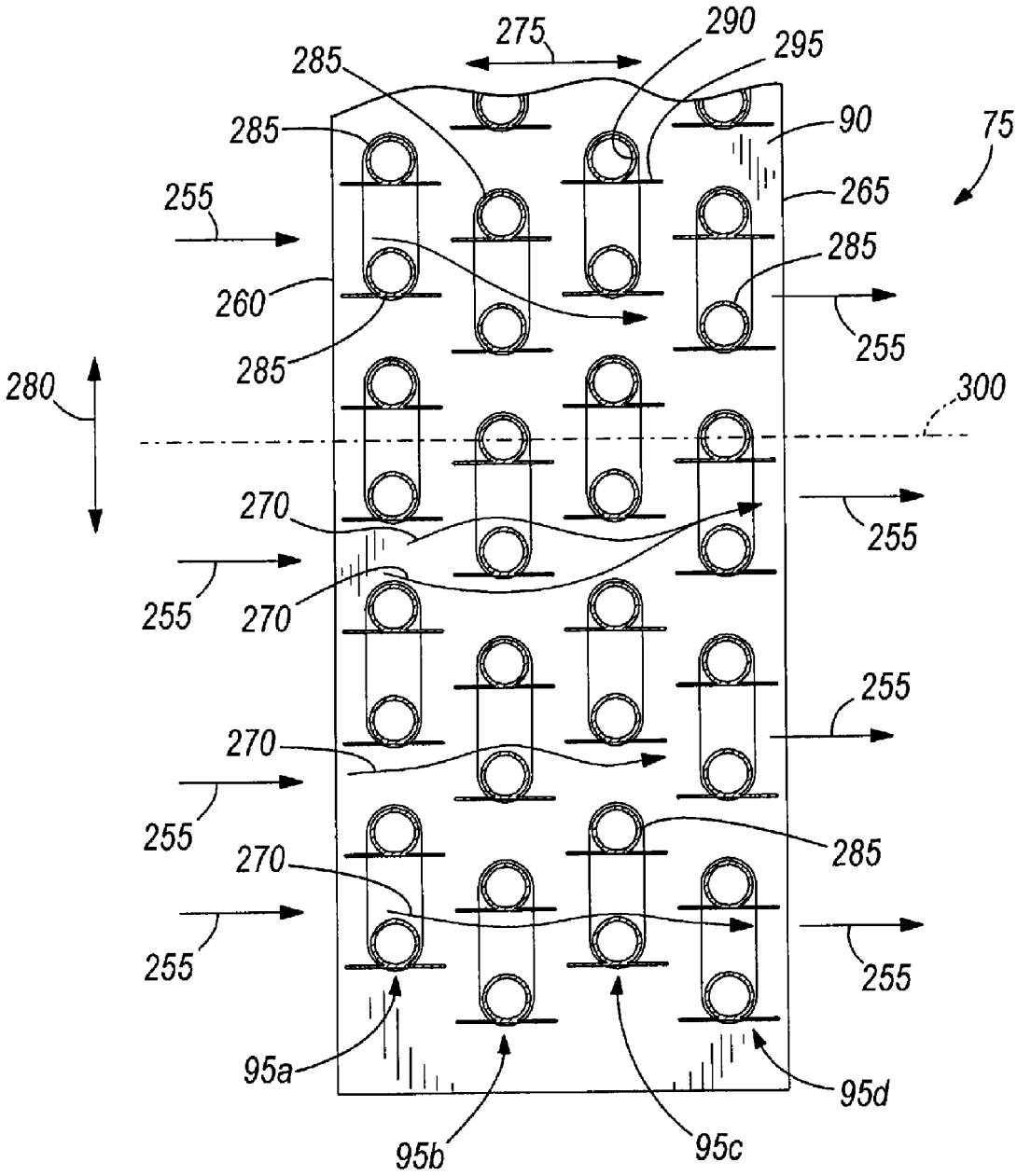
FIG. 12 is a section view of the evaporator assembly of FIG. 1.

In some constructions, the evaporator coils 95 of the evaporator assembly 75 can have wing tube profiles similar to the wing tube profiles described with regard to the condenser coils 115, 215 illustrated in FIGS. 2-11 to increase the velocity of air flowing over the evaporator coils 95. For example, FIG. 12 shows one construction of the evaporator assembly 75 that includes evaporator coils 95*a*, 95*b*, 95*c*, 95*d* having the Omega-wing tube profile. In the illustrated construction, the evaporator assembly 75 is generally upright within the refrigeration compartment 50 and is adapted to receive an airflow 255 generated by the fan assembly (not shown) in a substantially horizontal direction. The evaporator assembly 75 may include inlet and outlet manifolds (not shown), or alternatively the evaporator assembly 75 may be without inlet and outlet manifolds (e.g., a continuous tube evaporator assembly).

FIG. 12 shows that the airflow 255 enters the evaporator housing 90 adjacent a leading side 260 of the evaporator assembly 75, exits the evaporator housing 90 adjacent a trailing side 265 of the evaporator assembly 75, and flows along airflow paths 270 defined by the evaporator housing 90 between the leading side 260 and the trailing side 265. The evaporator housing 90 also defines a lateral direction 275 (e.g., a horizontal direction in FIG. 12 corresponding to a width of the evaporator assembly 75 between the leading side 260 and the trailing side 265 along the airflow paths 270), and a longitudinal direction 280 (e.g., a vertical direction in FIG. 12 corresponding to a height of the evaporator assembly 75) between an upper portion of the evaporator assembly 75 and a lower portion of the evaporator assembly 75. In the illustrated construction, the longitudinal direction 280 is substantially transverse to the airflow 255 entering the evaporator housing 90 and the lateral direction 275.

Each of the evaporator coils 95*a*, 95*b*, 95*c*, 95*d* illustrated in FIG. 12 is spaced apart from the remaining evaporator coils 95*a*, 95*b*, 95*c*, 95*d* in the lateral direction 275, and includes a plurality of coil sections 285 that are spaced apart from each other in the longitudinal direction 280. Generally, the coils 95 can be positioned in close proximity to each other (e.g., a high coil density application such as a medium temperature merchandiser), or alternatively, the coils 95 can be generally spaced apart from each other (e.g., a low coil density application such as a low temperature merchandiser). For example, a generally low coil density evaporator assembly may be desirable to avoid frost buildup on the coil sections 285 and to extend the time interval between defrost operations.

As shown in FIG. 12, each coil section 285 includes a tube 290 and a plate 295 tangentially coupled to the tube 290 to form the Omega-wing tube profile. Each plate 295 is substantially parallel to an axis 300 extending through the evaporator housing 90 (e.g., along the lateral direction 275) such that the plates 295 of the coil sections 285 are substantially parallel to each other. The coil sections 285 are similar to the coil sections 160 described with regard to the condenser assembly 85 illustrated in FIG. 4, and will not be discussed in detail.

The airflow 255 is directed toward the evaporator assembly 75 such that the airflow 255 prior to entry into the evaporator assembly 75 is generally non-orthogonal relative to the orientation of the plates 295 (e.g., substantially along the axis 300 parallel to the plates 295 as shown in FIG. 12). Similarly, the airflow exiting the evaporator assembly 75 is directed away from the evaporator coils 95 in a direction that is substantially parallel to the plates 295.

Figure 13:
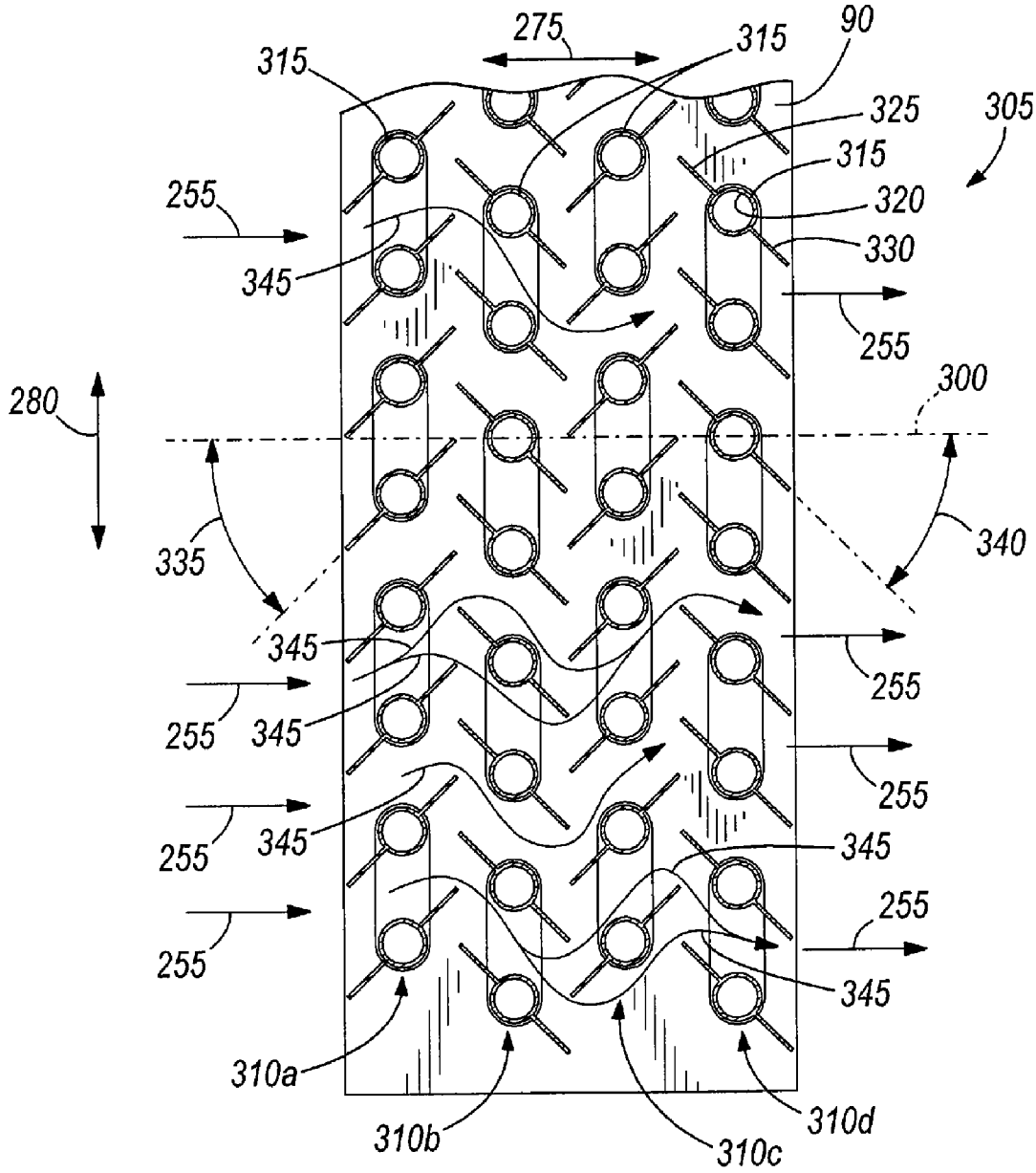
FIG. 13 is a section view of another evaporator assembly for use in the refrigerated merchandiser of FIG. 1.

FIG. 13 shows another construction of an evaporator assembly 305 that is positionable in the rear portion of the refrigeration compartment 50. Except as described below, the evaporator assembly 305 is the same as the evaporator assembly 95 described with regard to FIGS. 1 and 12, and common elements have the same reference numerals. As illustrated in FIG. 13, the evaporator assembly 305 includes the evaporator housing 90 defining the lateral direction 275 and the longitudinal direction 280, and four evaporator coils 310*a*, 310*b*, 310*c*, 310*d*.

The evaporator coils 310*a*, 310*b*, 310*c*, 310*d* are spaced apart from each other in the lateral direction 275, and each evaporator coil 310*a*, 310*b*, 310*c*, 310*d* includes a plurality of coil sections 315 that are spaced apart from each other in the longitudinal direction 280. Each of the coil sections 315 includes a substantially cylindrical tube 320, a first plate 325 coupled to the tube 320, and a second plate 330 coupled to the tube 320 diametrically opposite the first plate 330. The tube 330 and the first and second plates 325, 330 cooperate to define a wing tube profile that is similar to the wing tube profile described with regard to the condenser assembly 210 illustrated in FIGS. 10 and 11. The coil sections 315 are similar to the coil sections 220 described with regard to the condenser assembly 210 illustrated in FIG. 10.

The plates 325, 330 of each of the coil sections 315 of the first and third evaporator coils 310*a*, 310*c* are oriented at a first non-zero angle 335 relative to the axis 300 through the evaporator housing 90. The plates 325, 330 of each of the coil sections 310 of the second and fourth evaporator coils 310*b*, 310*d* are oriented at a second non-zero angle 340 relative to the axis 300. In the illustrated construction, the plates 325, 330 of the coil sections 315 of the second and fourth evaporator coils 310*b*, 310*d* extend in a substantially opposite direction relative to the plates 325, 330 of the first and third evaporator coils 310*a*, 310*c*. In other constructions, the plates 325, 330 of the respective evaporator coils 310 may be substantially parallel to each other. In still other constructions, the plates 325, 330 of the respective evaporator coils 310 may be non-parallel to each other and extend in non-opposite directions.

In the illustrated construction, the first non-zero angle 335 and the second non-zero angle 340 are both approximately 45 degrees such that the plates 325, 330 of the second evaporator coil 310*b* are substantially orthogonal to the plates 325, 330 of the first evaporator coil 310*a* and the third evaporator coil 310*c*. Similarly, the plates 325, 330 of the fourth evaporator coil 310*d* are substantially orthogonal to the plates 325, 330 of the first and third evaporator coils 310*a*, 310*c* (e.g., parallel to the plates 325, 330 of the second evaporator coil 310*b*). In other constructions, the first non-zero angle 335 and the second non-zero angle 340 may be larger or smaller than 45 degrees. In still other constructions, the first non-zero angle 335 may be different from the second non-zero angle 340.

The plates 325, 330 of the respective evaporator coils 310 define airflow paths 345 between the leading and trailing sides 260, 265 of the evaporator assembly 305 and around the coil sections 315. The airflow 255 is directed toward the evaporator assembly 305 such that the airflow 255 prior to entry into the evaporator assembly 305 is generally non-orthogonal relative to the orientation of the plates 325, 330. FIG. 13 shows that the direction of the airflow 255 is angled relative to the orientation of the plates 325, 330 (e.g., the airflow 255 is directed in a non-orthogonal, non-parallel direction relative to the orientation of the plates 325, 330). The airflow 255 exiting the evaporator assembly 305 is directed away from the evaporator coils 310 in a direction that is angled relative to the orientation of the plates 325, 330 (e.g., the airflow 255 is directed away from the evaporator coils 310 in a non-orthogonal, non-parallel direction relative to the orientation of the plates 325, 330). The staggered relationship between adjacent evaporator coils 310 and the orientation of the plates 325, 330 of each coil section 315 divide or direct the incoming airflow 255 into multiple airflow paths 345 through the evaporator housing 90, which improves heat transfer between the refrigerant and the airflow 255 through the evaporator housing 90, thereby improving the efficiency of the evaporator assembly 305.

In operation, the evaporator assembly 75, 305 is configured to receive a saturated refrigerant that has passed through an expansion valve. The saturated refrigerant is evaporated as it passes through the evaporator coils 95, 310 as a result of absorbing heat from the airflow 255 passing over the evaporator assembly 75, 305. The heated or gaseous refrigerant then exits the evaporator coils 95, 310 and is pumped back to one or more compressors (not shown) before entering the condenser assembly 85, 210. Ambient air is drawn through the louvered cover 55 into the refrigeration compartment 50 and through the condenser assembly 85, 210 by the fan assembly 80. The air heated by heat transfer with refrigerant in the condenser assembly 85, 210 is then discharged through another portion of the louvered cover 55.

As shown in FIGS. 4 and 10, the airflow 130 enters the condenser assembly 85, 210 adjacent the leading side 140 of the condenser housing 100 in a substantially horizontal direction. The airflow 130 through the condenser housing 100 is staggered and divided based on the staggered relationship of the condenser coils 115, 215 and the orientation of the plates 170, 175, 180, 230, 235. The airflow paths 135 defined by the substantially horizontal plates 170 illustrated in FIG. 4 follow less resistive flow paths than airflow paths 250 defined by the angled plates 230, 235 that are illustrated in FIG. 10, which results in different heat transfer characteristics for the condenser coils 115 of FIG. 4 and the condenser coils 215 of FIG. 10. The angles at which the plates 170, 175, 180, 230, 235 are oriented can be modified to provide desired heat transfer characteristics and desired resistive flow paths for the condenser assembly 85, 210.

The wing tube profile of the coil sections 160, 220 increases the surface area of the condenser coils 115, 215, which increases the heat transfer capability of the respective coils 115, 215. The wing tube profile also increases the velocity of the airflow 130 over the condenser coils 115, 215 to minimize fouling of the coil sections 160, 220. In particular, the wing tube profile disturbs the flow direction of the airflow 130 with minimal wake formation, which increases the velocity of the airflow 130 in critical heat transfer regions (e.g., adjacent the surface of the tubes 165, 225) along the airflow paths 135, 230 within the condenser housing 100. The increased velocity airflow 130 provided by the wing tube profile minimizes fluid flow decrease (i.e., minimal decrease in the velocity of the airflow 130) throughout the condenser assembly 85, 210, leading to fewer, if any, zero velocity "dead zones" in the condenser housing 100. The increased velocity airflow 130 leads to a corresponding increase in the temperature gradient of the condenser coils 115, 215 as compared to conventional bare-tube condenser coils, which improves the heat transfer characteristics of the condenser assembly 85, 210.

Although the evaporator coils 95, 310 are less likely to become fouled and/or clogged relative to the condenser coils 115, 215, the wing tube profiles on the evaporator coils 95, 310 minimize fouling of the corresponding evaporator coil sections 285, 315 and improve the heat transfer efficiency of the evaporator assembly 75, 305, thereby improving the efficiency of the refrigeration system 70. Although the invention is described in detail with regard to the condenser assemblies 85, 215, the invention is equally usable in condenser assemblies and evaporator assemblies and should not be limited to only one type of assembly.

Various features and advantages of the invention are set forth in the following claims.

The invention claimed is:

1. A heat exchanger coil for a heat exchanger assembly having a housing defining at least one airflow path and adapted to receive an airflow for heating or cooling refrigerant in the heat exchanger coil, the heat exchanger coil comprising:

a substantially cylindrical tube for receiving the refrigerant; and at least one plate coupled to and extending along a substantial length of the tube, the plate oriented so that the direction of the airflow adapted to enter the housing is non-orthogonal relative to the orientation of the plate.

2. The heat exchanger coil of claim 1, wherein the at least one plate is substantially parallel to the airflow adapted to enter the housing.

3. The heat exchanger coil of claim 2, wherein the at least one plate is substantially parallel to the airflow adapted to exit the housing.

4. The heat exchanger coil of claim 1, wherein the at least one plate is oriented such that the airflow adapted to exit the housing is non-orthogonal relative to the plate.

5. The heat exchanger coil of claim 1, wherein the at least one plate is oriented such that the airflow is adapted to enter the housing in a non-orthogonal, non-parallel direction relative to the plate.

6. The heat exchanger coil of claim 5, wherein the at least one plate is oriented at a non-zero angle.

7. The heat exchanger coil of claim 1, wherein the airflow is adapted to flow generally across the coil section substantially along a lateral direction defined by the housing.

8. The heat exchanger coil of claim 1, wherein the plate includes a non-planar profile.

9. The heat exchanger coil of claim 1, wherein the plate is tangentially coupled to the tube.

10. The heat exchanger coil of claim 9, wherein the plate is positioned adjacent a lower side of the tube.

11. The heat exchanger coil of claim 1, wherein the at least one plate includes a first plate and a second plate coupled to the tube on diametrically opposite sides of the tube.

12. A heat exchanger assembly comprising:

a housing adapted to receive an airflow and defining at least one airflow path therethrough;

an inlet manifold including an inlet port for receiving refrigerant;

an outlet manifold including an outlet port for discharging the refrigerant; and a heat exchanger coil coupled to and extending between the inlet manifold and the outlet manifold, the heat exchanger coil including a plurality of coil sections spaced apart from each other, each of the coil sections having a substantially cylindrical tube and at least one plate coupled to and extending along a substantial length of the tube, each plate oriented so that the direction of the airflow adapted to enter the housing is non-orthogonal relative to the orientation of the plate.

13. The heat exchanger assembly of claim 12, wherein the at least one plate is coupled to the corresponding tube without being coupled to another tube of the plurality of coil sections.

14. The heat exchanger assembly of claim 12, wherein the plates are substantially parallel to the airflow adapted to enter the housing.

15. The heat exchanger assembly of claim 14, wherein the plates are substantially parallel to the airflow adapted to exit the housing.

16. The heat exchanger assembly of claim 12, wherein the plates are oriented such that the airflow adapted to exit the housing is non-orthogonal relative to the plates.

17. The heat exchanger assembly of claim 12, wherein the plates are oriented such that the airflow is adapted to enter the housing in a non-orthogonal, non-parallel direction relative to the plates.

18. The heat exchanger assembly of claim 17, wherein the plates are oriented at a non-zero angle.

19. The heat exchanger assembly of claim 12, wherein the airflow is adapted to flow generally across the coil section substantially along a lateral direction defined by the housing.

20. The heat exchanger assembly of claim 12, wherein each of the plates includes a non-planar profile.

21. The heat exchanger assembly of claim 12, wherein at least some of the plates are tangentially coupled to the corresponding tubes.

22. The heat exchanger assembly of claim 21, wherein the plates are positioned adjacent a lower side of the corresponding tube.

23. The heat exchanger assembly of claim 12, wherein the heat exchanger coil is a condenser coil.

24. The heat exchanger assembly of claim 12, wherein each of the coil sections includes a first plate and a second plate coupled to the tube on diametrically opposite sides of the tube.

25. The heat exchanger assembly of claim 12, wherein the housing defines a lateral direction substantially along the at least one airflow path and a longitudinal direction substantially transverse to the lateral direction, and wherein the heat exchanger coil is a first heat exchanger coil, the heat exchanger assembly further including a second heat exchanger coil spaced apart from the first heat exchanger coil in the lateral direction.

26. The heat exchanger assembly of claim 25, wherein the second heat exchanger coil includes a plurality of coil sections that are staggered in the longitudinal direction relative to the plurality of coil sections of the first heat exchanger coil.

27. The heat exchanger assembly of claim 25, wherein the at least one plate of each of the coil sections of the first heat exchanger coil is oriented at a first non-zero angle relative to an axis through the housing, and the at least one plate of each of the coil sections of the second heat exchanger coil is oriented at a second non-zero angle relative to the axis.

28. The heat exchanger assembly of claim 27, wherein the second non-zero angle is different from the first non-zero angle.

29. The heat exchanger assembly of claim 27, wherein the at least one plate of each of the coil sections of the first heat exchanger coil is oriented in a first direction, and the at least one plate of each of the coil sections of the second heat exchanger coil is oriented in a second direction different from the first direction.

30. The heat exchanger assembly of claim 27, wherein the plates of the first heat exchanger coil and the plates of the second heat exchanger coil are substantially parallel to each other.

31. A refrigerated merchandiser comprising:

a case defining a product display area and including a rear wall partially defining a rear passageway, the case further including an accessible refrigeration compartment;

a fan assembly including a fan positioned in at least one of the rear passageway and the refrigeration compartment for generating an airflow; and a heat exchanger assembly defining at least one airflow path and including a housing positioned to receive the airflow generated by the fan, an inlet manifold for receiving refrigerant, an outlet manifold for discharging the refrigerant, and a heat exchanger coil coupled to and extending between the inlet manifold and the outlet manifold and having a plurality of coil sections spaced apart from each other, each of the coil sections having a substantially cylindrical tube and at least one plate coupled to and extending along a substantial length of the tube, each plate oriented so that the direction of the airflow adapted to enter the housing is non-orthogonal relative to the orientation of the plate.

32. The refrigerated merchandiser of claim 31, wherein the at least one plate is coupled to the corresponding tube without being coupled to another tube of the plurality of coil sections.

33. The refrigerated merchandiser of claim 31, wherein the plates are oriented such that the airflow is adapted to enter the housing in a non-orthogonal, non-parallel direction relative to the plates.

34. The refrigerated merchandiser of claim 31, wherein at least some of the plates are tangentially coupled to the corresponding tubes.

35. The refrigerated merchandiser of claim 31, wherein the heat exchanger coil is a condenser coil.

36. The refrigerated merchandiser of claim 31, wherein each of the coil sections includes a first plate and a second plate coupled to the tube on diametrically opposite sides of the tube.

37. The refrigerated merchandiser of claim 31, wherein the housing defines a lateral direction substantially along the at least one airflow path and a longitudinal direction substantially transverse to the lateral direction, and wherein the heat exchanger coil is a first heat exchanger coil, the heat exchanger assembly further including a second heat exchanger coil spaced apart from the first heat exchanger coil in the lateral direction and staggered relative to the first heat exchanger coil in the longitudinal direction.

* * * * *